US010071887B2

(12) United States Patent
Hudgens et al.

(10) Patent No.: US 10,071,887 B2
(45) Date of Patent: Sep. 11, 2018

(54) UNIVERSAL COMPONENT LIFT APPARATUS, ASSEMBLIES, AND METHODS FOR ELECTRONIC DEVICE MANUFACTURING

(71) Applicant: Applied Materials, Inc., Santa Clara, CA (US)

(72) Inventors: Jeffrey C. Hudgens, San Francisco, CA (US); Alpay Yilmaz, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 49 days.

(21) Appl. No.: 14/521,080

(22) Filed: Oct. 22, 2014

(65) Prior Publication Data

US 2015/0110586 A1 Apr. 23, 2015

Related U.S. Application Data

(60) Provisional application No. 61/894,873, filed on Oct. 23, 2013.

(51) Int. Cl.
*B66C 9/00* (2006.01)
*B66C 19/02* (2006.01)
*B66C 23/48* (2006.01)

(52) U.S. Cl.
CPC ..... *B66C 9/00* (2013.01); *B66C 19/02* (2013.01); *B66C 23/48* (2013.01)

(58) Field of Classification Search
CPC ..... B66C 19/02; B66C 9/00; B66C 23/48
USPC ..... 414/560, 561
See application file for complete search history.

(56) References Cited

U.S. PATENT DOCUMENTS 3,160,115 A * 12/1964 Bradt ..... B61B 10/04 104/172.5
3,237,798 A * 3/1966 Hampl ..... A01B 51/04 414/460
4,227,464 A * 10/1980 Wallace ..... B66C 19/02 104/126
5,341,614 A * 8/1994 Shimizu ..... E04B 5/48 52/126.5
5,406,880 A 4/1995 Haller
(Continued)

FOREIGN PATENT DOCUMENTS

CN 103227131 A 7/2013
GB 1162405 * 8/1969 ..... B66C 23/18
(Continued)

OTHER PUBLICATIONS

International Search Report and Written Opinion of International Application No. PCT/US2014/061771 dated Jan. 28, 2015.
(Continued)

*Primary Examiner* — Ronald P Jarrett
(74) *Attorney, Agent, or Firm* — Dugan & Dugan, PC

(57) ABSTRACT

Universal component lift apparatus for moving components of electronic device manufacturing systems is described. The universal component lift apparatus includes a track, a truck moveable along the track, and a lift apparatus adapted to couple to the truck, the lift apparatus including a wheeled base, a lift portion, and a boom adapted to couple to the component. Electronic device processing systems and methods of moving components thereof are described, as are numerous other aspects.

18 Claims, 23 Drawing Sheets

(56) References Cited

U.S. PATENT DOCUMENTS

| | | | | |
|---|---|---|---|---|
| 5,575,220 | A * | 11/1996 | van Soest | B66C 19/00 104/244 |
| 6,450,514 | B1 * | 9/2002 | Ronca | B62B 3/108 211/41.14 |
| 6,688,838 | B2 | 2/2004 | Lavitsky et al. | |
| 2002/0025244 | A1 * | 2/2002 | Kim | H01L 21/67775 414/217 |
| 2004/0091338 | A1 | 5/2004 | Kim | |
| 2004/0191032 | A1 | 9/2004 | Foulket et al. | |
| 2007/0055404 | A1 | 3/2007 | Flitsch | |
| 2007/0138466 | A1 * | 6/2007 | Lee | G01R 31/2893 257/48 |
| 2011/0206492 | A1 * | 8/2011 | Gaskin | E21B 12/04 414/800 |

FOREIGN PATENT DOCUMENTS

| | | |
|---|---|---|
| JP | 2001-354302 | 12/2001 |
| WO | WO 2007-058315 | 5/2007 |

OTHER PUBLICATIONS

Taiwan Search Report of Taiwan Application No. 103136508 dated Jun. 21, 2017.
Chinese Search Report of Chinese Application No. 201480058383.6 dated Jan. 31, 2018.
International Preliminary Report on Patentability of International Application No. PCT/US2014/061771 dated May 6, 2016.

* cited by examiner

UNIVERSAL COMPONENT LIFT APPARATUS, ASSEMBLIES, AND METHODS FOR ELECTRONIC DEVICE MANUFACTURING

RELATED APPLICATION

The present application claims priority to U.S. Provisional Application No. 61/894,873 filed Oct. 23, 2013, and entitled "UNIVERSAL COMPONENT LIFT APPARATUS, ASSEMBLIES, AND METHODS FOR ELECTRONIC DEVICE MANUFACTURING", which is hereby incorporated by reference herein for all purposes.

FIELD

The present invention relates to electronic device manufacturing.

BACKGROUND

Conventional electronic device manufacturing systems such as semiconductor device fabrication facilities (FABS) may include multiple tools arranged in relatively close proximity. Servicing such systems is difficult based on not only the large size, but the weight of the components. Conventionally, various equipment manufacturers typically provide tool-specific component lifts, so that the FABS may have a large mix of lift types, which ultimately add to the final cost and complexity of the FAB.

Accordingly, apparatus, assemblies, and methods for efficient and precise movement of components of FABS are desired.

SUMMARY

In one aspect, a component lift assembly is provided. The component lift assembly includes one or more tracks, one or more trucks moveable along the one or more tracks, and one or more lift apparatus adapted to couple to the one or more trucks, the one or more lift apparatus including a wheeled base, a lift portion, and a boom adapted to couple to a component.

In another aspect an electronic device processing system is provided. The electronic device processing system includes a plurality of substrate processing tools positioned on a floor, each of the substrate processing tools including FAB components, one or more lift assemblies adapted to lift or lower one or more of the FAB components, comprising one or more tracks, a truck moveable along each of the one or more tracks, and a lift apparatus adapted to couple to the truck, the lift apparatus including a wheeled base, a vertical lift coupled to the wheeled base, and a boom coupled to a moveable portion of the vertical lift and adapted to couple to the one or more FAB components.

In another aspect, a method of moving a component of an electronic device processing system is provided. The method includes providing a track including a truck, positioning a lift apparatus above the track, coupling the lift apparatus to the truck, coupling a boom of the lift apparatus to the component, lifting the component by moving the boom, and moving the lift apparatus along the monorail track to a desired location.

Numerous other aspects are provided in accordance with these and other embodiments of the invention. Other features and aspects of embodiments of the present invention will become more fully apparent from the following detailed description, the appended claims, and the accompanying drawings.

DESCRIPTION

Figure 1:
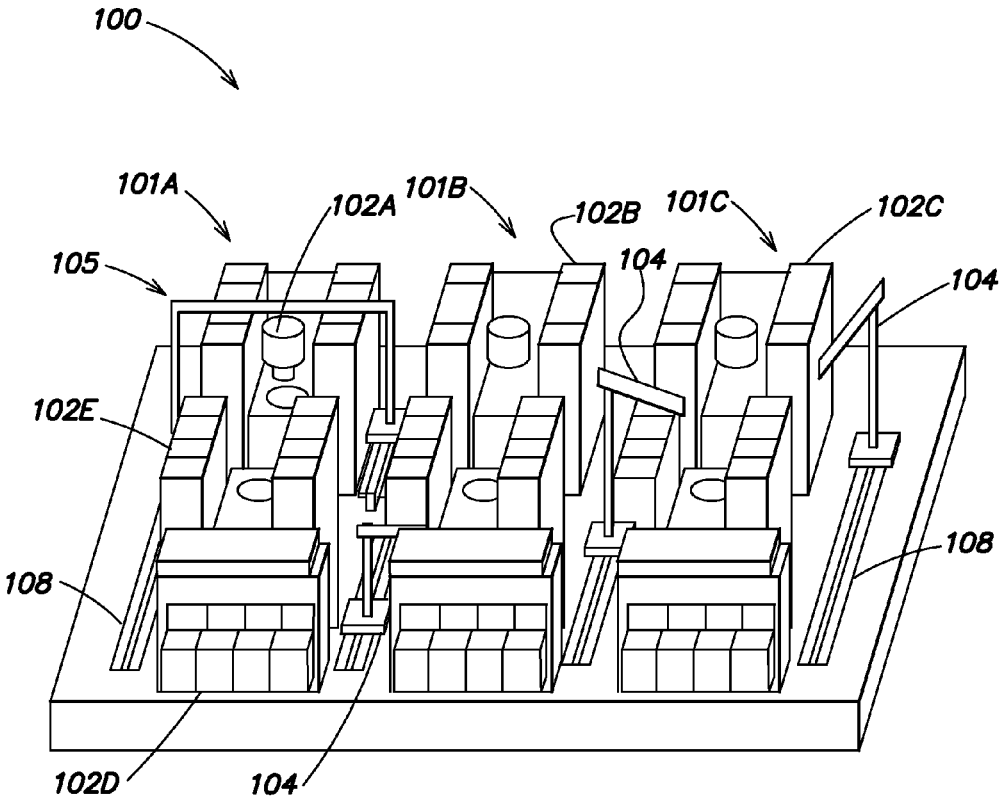
FIG. 1 illustrates a perspective view of an electronic device manufacturing system including multiple component lift assemblies according to embodiments.

In one aspect, embodiments of the invention provide a component lift assembly. The component lift assembly may be used in an electronic device processing system 100, such as a FAB to move (i.e., raise, lower, and/or translate) components of the FAB. The component lift assembly may utilize modular components at each tool 101A, 101B, 101C of the FAB thereby lowering the number of different types of lifts. Each tool 101A, 101B, 101C of the FAB may be provided by a different supplier, for example. The tools 101A-101C may be adapted to carry out any number of process steps on substrates, such as deposition, oxidation, nitration, etching, polishing, cleaning, lithography, or the like. Other processes may also be carried out therein. Substrates, as used herein, shall mean articles used to make electronic devices or circuit components, such as semiconductor wafers, silica-containing wafers, glass plates, glass panels, masks, or the like.

One or more component lift assemblies 104 may be used to move components 102A-102E of the FAB. In another aspect, the component lift assembly 104 is modular utilizing multiple common subcomponents. Accordingly, the component lift assembly 104 is highly flexible and adjustable.

According to one or more embodiments of the invention, a component lift assembly 104, as shown in FIGS. 1-15 herein, is provided. Component lift assembly 104 includes one or more tracks 108, a truck 110 (FIGS. 4, 7 and 8) moveable along the one or more tracks 108, and a lift apparatus 106, such as the boom lift shown. The lift apparatus 106 is configured and adapted to couple to the truck 110.

Figure 2:
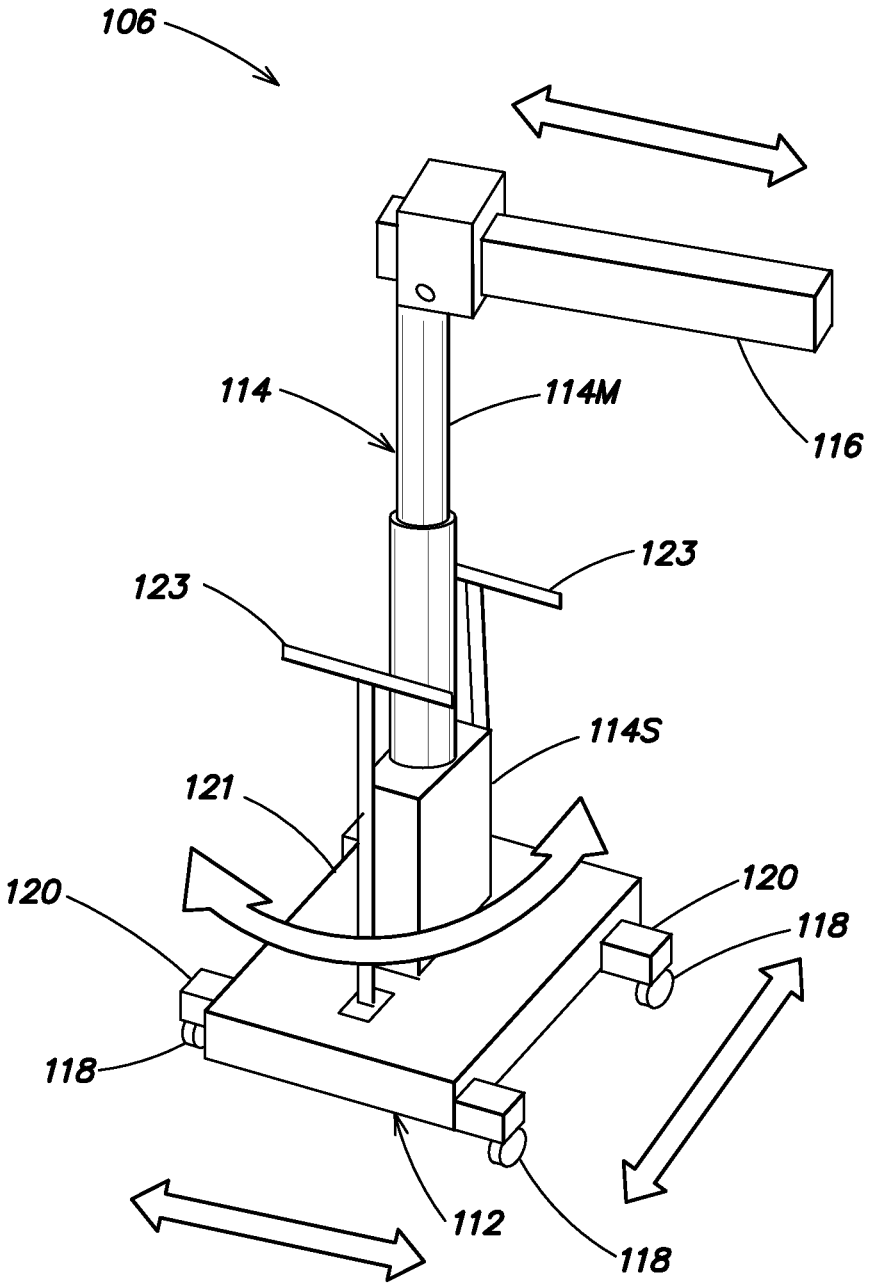
FIG. 2 illustrates a perspective view of a lift apparatus of a component lift assembly according to embodiments.
Figure 3:
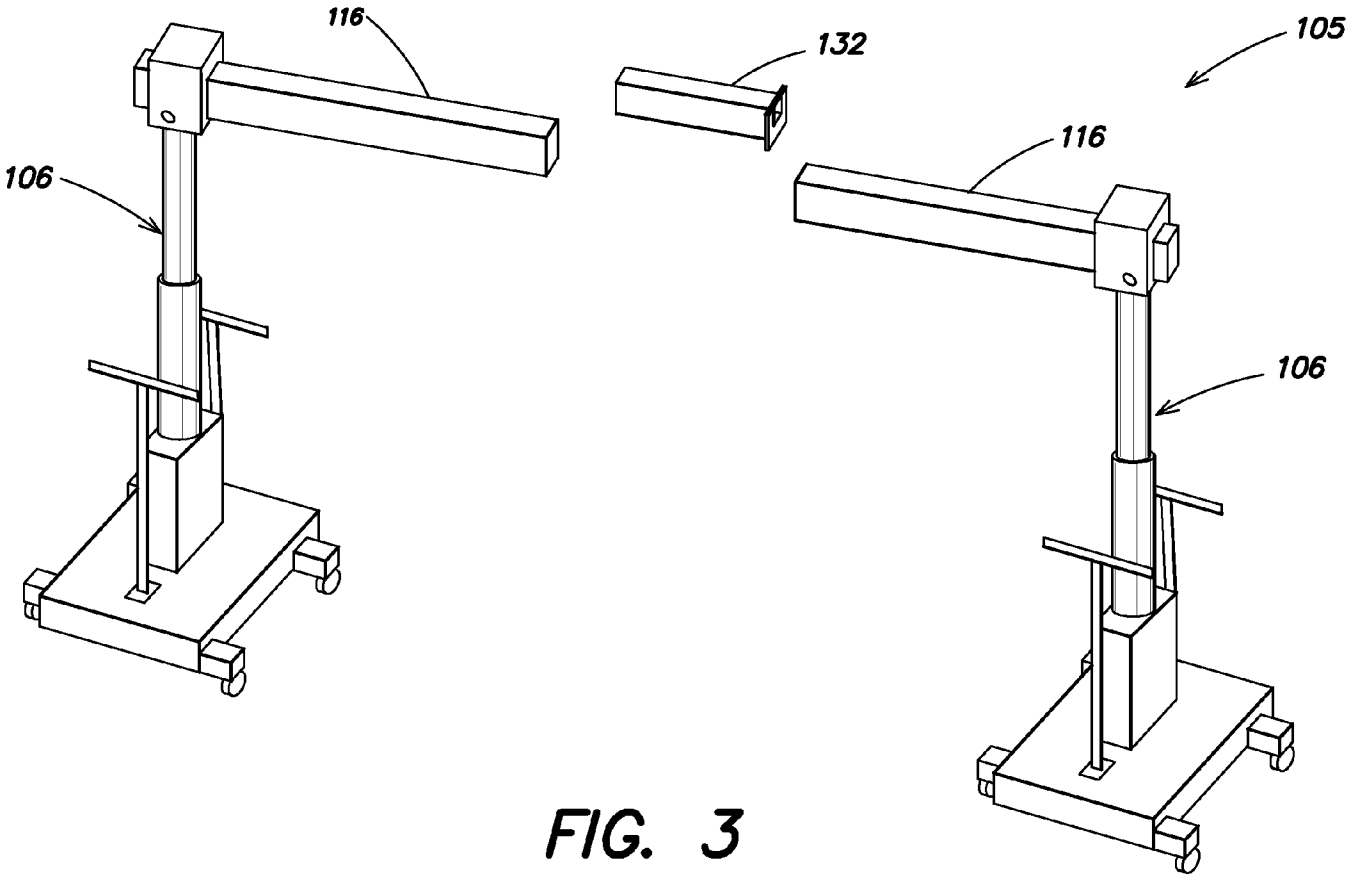
FIG. 3 illustrates a perspective view of a dual lift assembly including coupled lift apparatus according to embodiments.

Referring now to FIG. 2, the lift apparatus 106, in the depicted embodiment, includes a wheeled base 112, a lift portion 114 coupled to the wheeled base 112, and a boom 116 adapted to couple to the component 102A-102E sought to be moved.

Figure 5A:
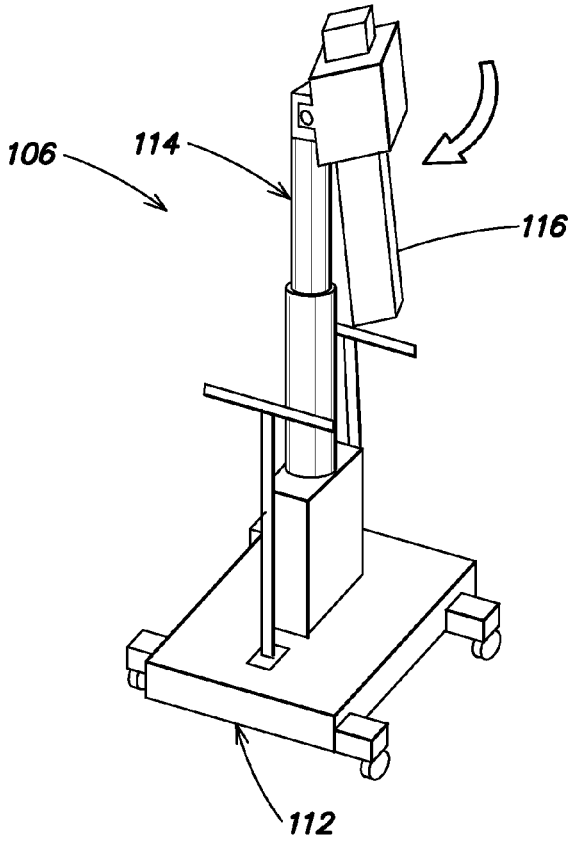
FIG. 5A illustrates a perspective view of a lift apparatus shown in a stored configuration according to embodiments.

FIGS. 2 and 5A illustrate perspective views of an example modular embodiment of a lift apparatus 106 useable with the component lift assembly 104 according to embodiments of the present invention. The wheeled base 112 may include three or more wheels 118, which are adapted to contact the floor of the FAB. The wheels 118 may be mounted to wheel rails 120 coupled to a base 121. Wheel rails 120 may extend through the base 121 from side to side or front to back and may support the base 121. Levelers may be included in the wheeled base 112 and may act against the floor or between the base 112 and the wheel rails 120 and may be operational to level or further support the lift apparatus 106. T-shaped tow handles 123 may be coupled to the wheeled base 112. Optionally, the wheeled base 112 may be driven along the track 108 by a motor-driven drive system, such as a servo motor, or the like.

Figure 4:
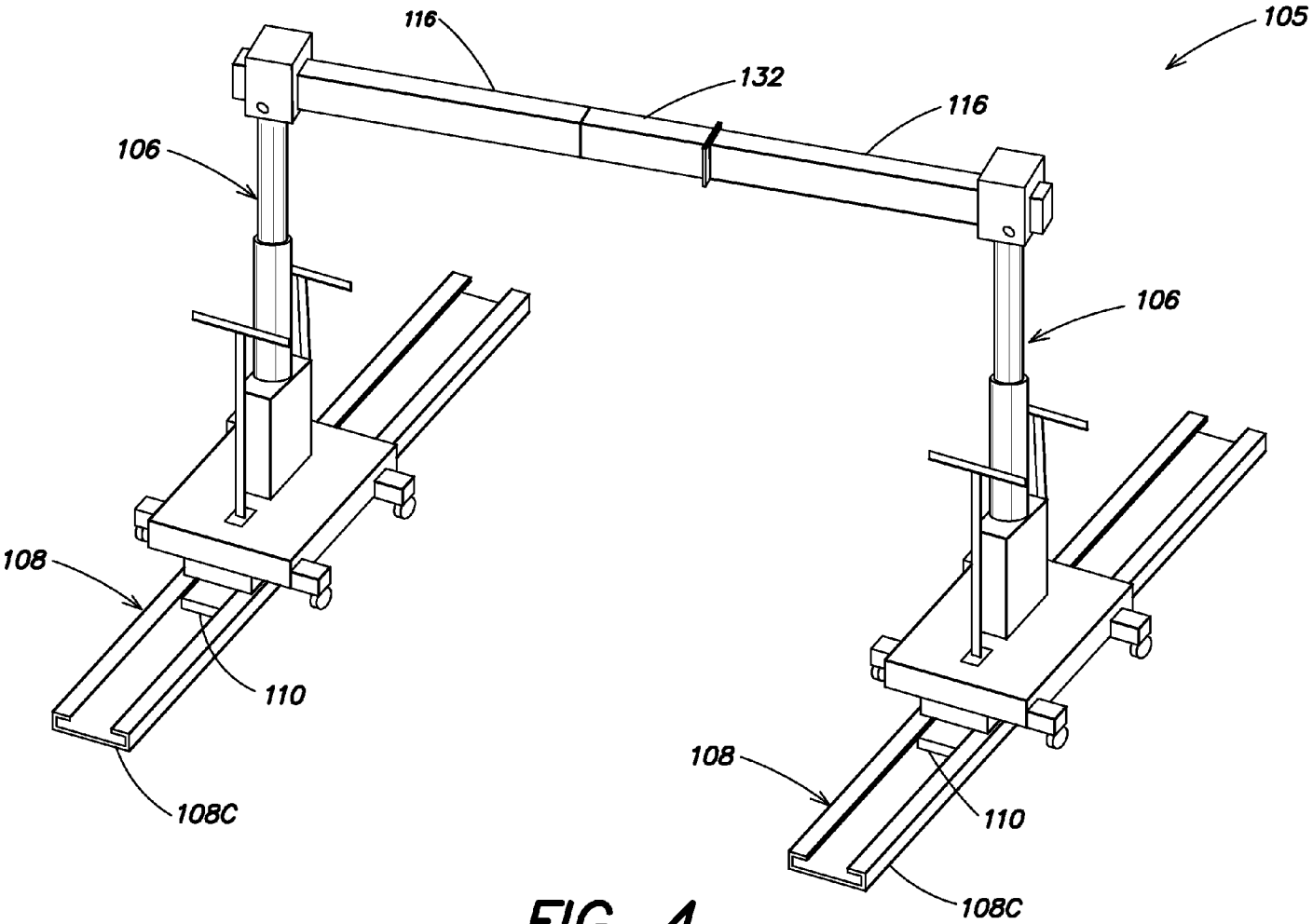
FIG. 4 illustrates a perspective view of a dual lift assembly coupled to trucks moveable on tracks according to embodiments.
Figure 9:
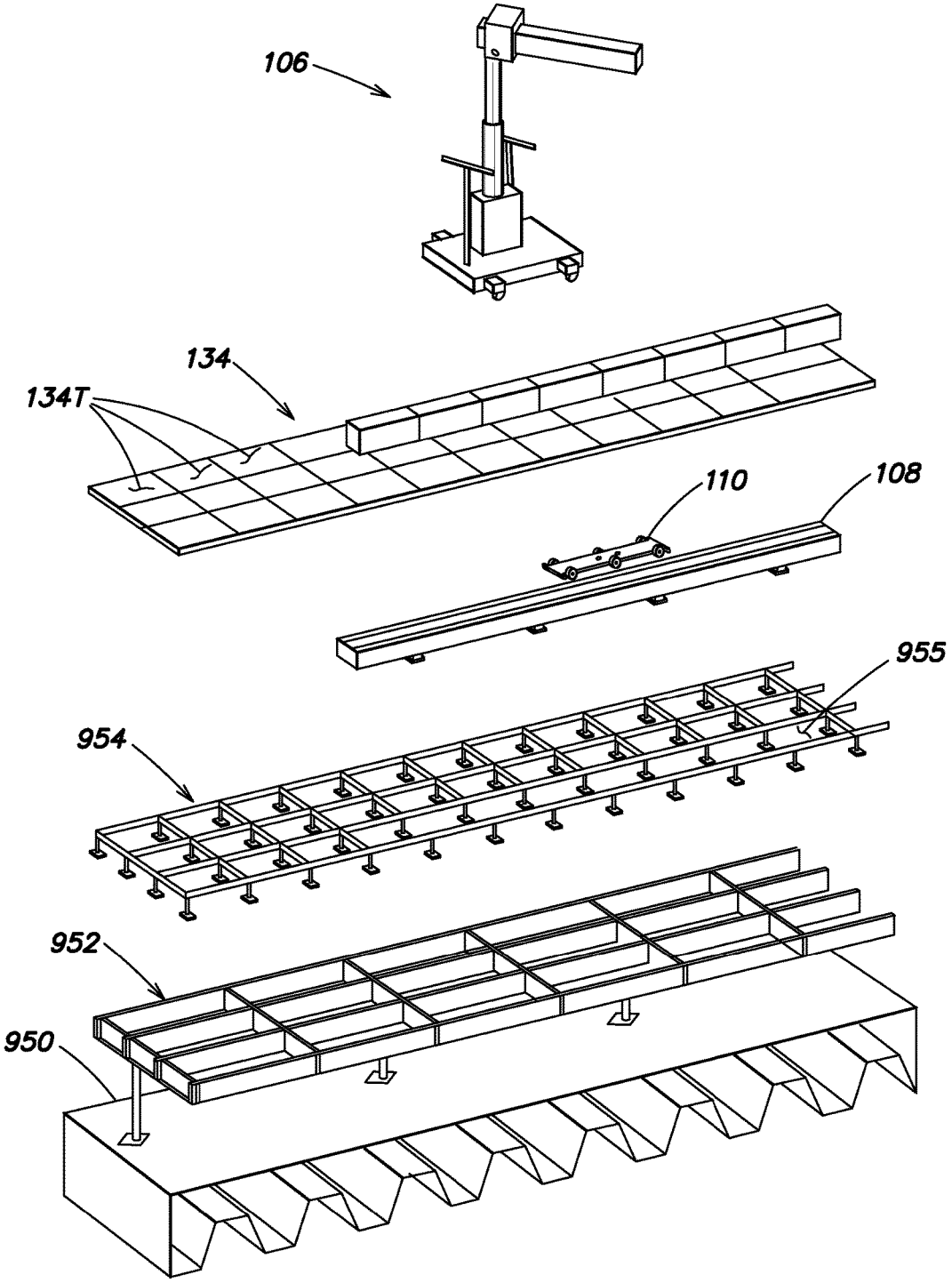
FIG. 9 illustrates an exploded view of floor portions and portions of the component lift assembly according to embodiments.

As best shown in FIGS. 1, 4 and 9, the component lift assembly 104 includes one or more tracks 108, which may comprise monorails that may include a captured channel 108C, which is adapted to capture the truck 110 therein. The captured channel 108C may include a C-shaped cross section as shown. The truck 110 may be captured by the captured channel 108C by having the truck wheels 124 sized to be in close proximity (e.g., a few mm) from the top of the channel, so that only a slight amount of play is provided. Other track shapes may be used. In particular, the track 108 may have a monorail mounted in an under-floor configuration. The track 108 may be mounted to track supports or otherwise mounted to a suspended floor structure.

As shown in FIGS. 1, 4, 9, 10 and 13, the one or more tracks 108 comprising a plurality of monorails may be provided in a substantially parallel orientation with each other. One track 108 may reside between each tool, alongside each tool, or both. In some embodiments, an individual track may be provided.

Figure 7:
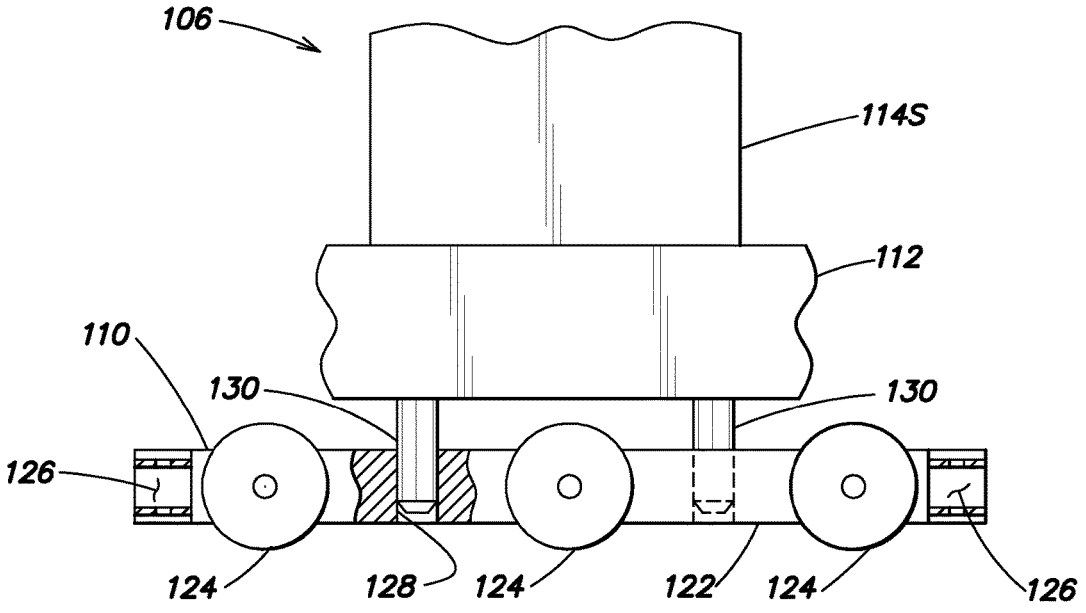
FIG. 7 illustrates a partially cross-sectioned side view of connection of a boom lift to a truck according to embodiments.
Figure 8:
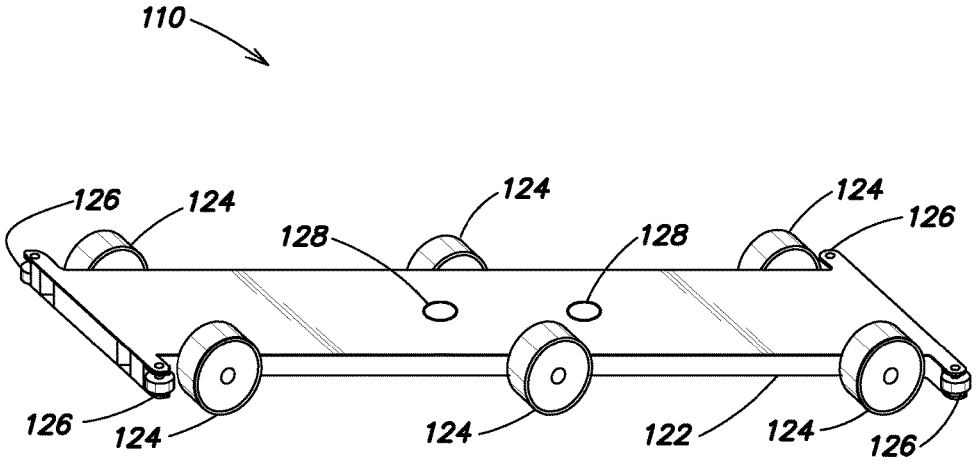
FIG. 8 illustrates a perspective view of a truck according to embodiments.

One embodiment of a truck 110 useable with the component lift assembly 104 is shown in FIG. 7 and FIG. 8. Truck 110 may include a truck frame 122 and four or more truck wheels 124 rotationally coupled to the truck frame 122 and adapted to engage the track 108 (e.g., monorail). Truck wheels 124 may be sized so that they are in close proximity with the respective top and bottom portions of the track 108. Six truck wheels 124 may be included in some embodiments. Other numbers of truck wheels 124 may be used. Side wheels 126 may be mounted to the truck frame 122, such as at the respective ends thereof. Side wheels 126 help maintain the side-to-side orientation of the truck 110 within the captured channel 108C of the track 108. Side wheels 126 may be sized so that they are in close proximity with the respective side portions of the track 108. Four side wheels 126 are shown, but other numbers of side wheels 126 may be used. Optionally, truck wheels 124 and/or side wheels 126 may be eccentrically adjustable or otherwise capable of being offset to minimize play when riding in the track 108.

In one or more embodiments, as shown in FIG. 7, the lift apparatus 106 may be lockable to the truck 110. In some embodiments, the lift apparatus 106 may be detachable from the truck 110. This functionality of being lockable and/or detachable may be provided by two or more lift engagement features 128 that are configured and adapted to engage with two or more truck engagement features 130 on the lift apparatus 106. The lift engagement features 128 may be holes formed in the truck frame 122. The truck engagement features 130 may be pins or the like. The truck engagement features 130 may be extendable from and retractable from or into the wheeled base 112 in some embodiments. Extension and retraction may be accomplished by any suitable mechanism, such as a pivoting latch, crank, lever, hand wheel, or the like (not shown).

Referring now to FIG. 2, the lift apparatus 106 of the component lift assembly 104 may include a vertical lift as the lift portion 114 coupled to the wheeled base 112. The lift portion 114 may include a stationary portion 114S coupled to the wheeled base 112, and a moveable portion 114M moveable relative to the stationary portion 114S. The boom 116 may be coupled to the moveable portion 114. Operation of a lift mechanism of the lift portion 114 raises the boom 116 and any coupled component. Lift mechanism may be a heavy-duty vertical lift motor coupled to a rack and gear transmission or the like. Any suitable lift mechanism, including a manual crank or pump type lift mechanism, may be used. The moveable portion 114M may be telescopeable relative to the stationary portion 114S in some embodiments. Likewise, the boom 116 may be extendible laterally from the moveable portion 114M. The boom 116 may also be rotatable about a vertical axis of the moveable portion 114M.

In some embodiments, as shown in FIGS. 1, 3, 4 and 6, the component lift assembly 105 may be constructed to include a first lift apparatus 106 coupled to a first truck 110 on a first side of the tool (e.g., tool 101A), and a second lift apparatus 106 coupled to a second truck 110 on a second side of the tool, so as to straddle the tool. Respective booms 116 of the lift apparatus 106 may be coupled with bridge bracket 132. Other suitable connections between the booms 116 may be used.

FIG. 9 illustrates an exploded view of various portions of the floor assembly. In particular, the floor 134, comprised of a plurality of floor tiles 134T (a few labeled), may be raised from the floor base 950 by a first floor structure 952 and a second floor structure 954. Floor base 950 may be made of any rigid base construction, such as concrete or combinations of steel and concrete. First floor structure 952 may be rigid grid-like structure of I-beams, for example. The second floor structure 954 may be mechanically coupled to the first floor structure 952 such as by fasteners and brackets. Second floor structure 954 may be a rigid grid-like structure of beams, for example. Second floor structure 954 operates to support the floor 134, and in particular the floor tiles 134T. Open sections 955 within the second floor structure 954 may receive the track 108. The track 108 may be coupled to the second floor structure 954 in some embodiments. In other embodiments, the track 108 may be coupled to the first floor structure 952.

Figure 11:
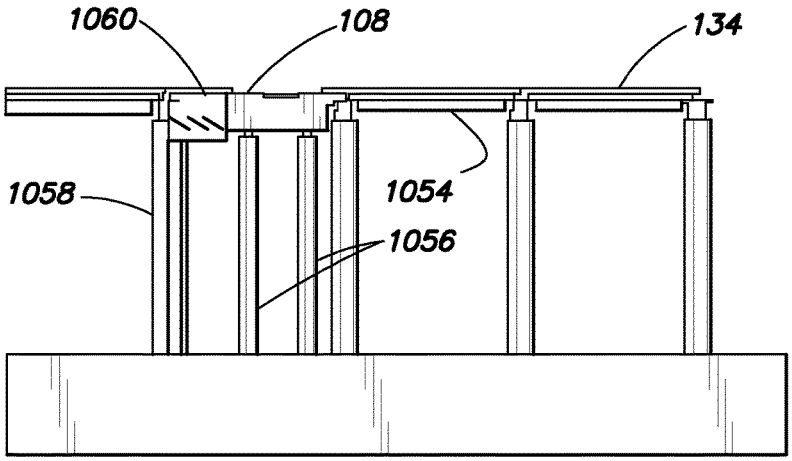
FIG. 11 illustrates a partial side view of under-floor mounted track of a component lift assembly mounted to a floor structure according to embodiments.
Figure 12:
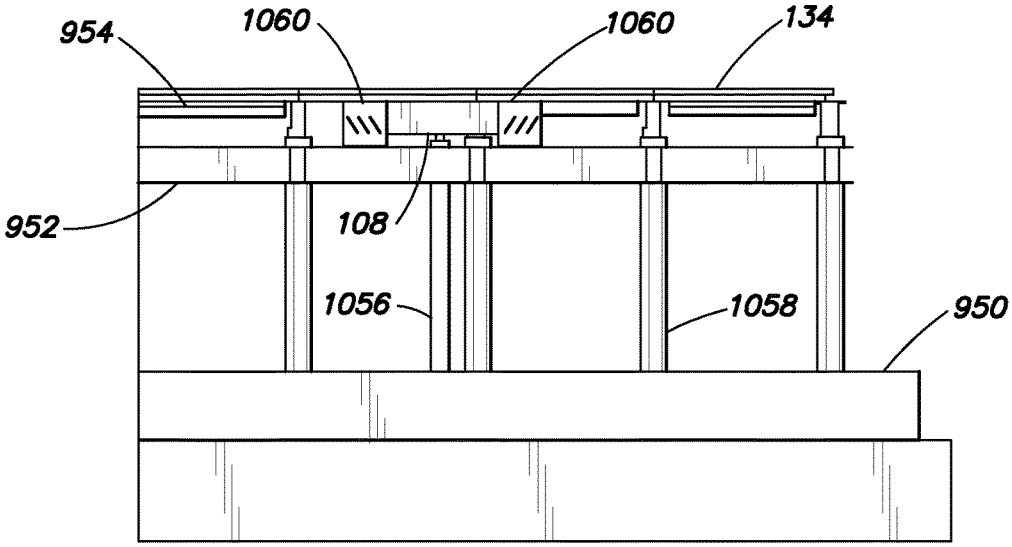
FIG. 12 illustrates a partial side view of under-floor mounted track of a component lift assembly mounted to alternative floor structure according to embodiments.

Additionally, or optionally, the track 108 may be supported relative to the floor base 950 by track supports 1056 as shown in FIGS. 11 and 12. FIGS. 11 and 12 illustrate several floor installations including the track 108 being provided in an under-floor mounted configuration, i.e., below floor 134. Floor supports 1058 may be coupled directly to a floor sub-support 1054 (FIG. 11), or to the first and second floor structures 952, 954 (FIG. 12). A life box 1060 may be included.

Figure 10:
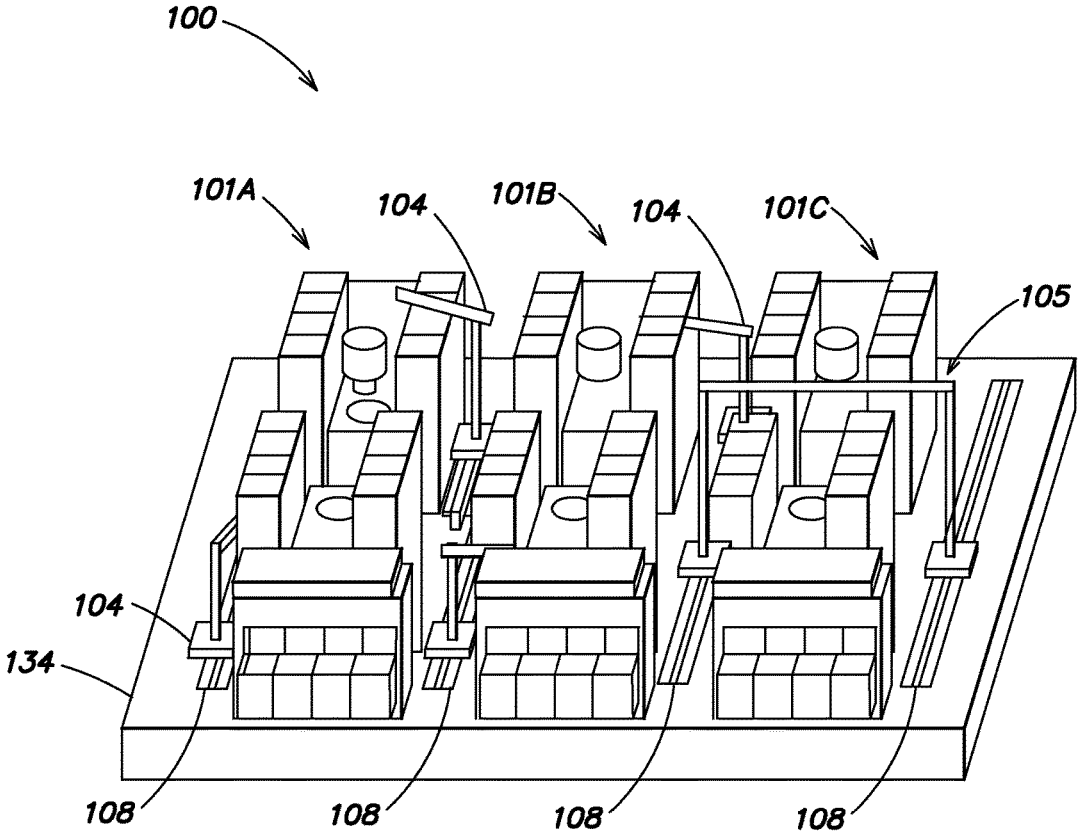
FIG. 10 illustrates another perspective view of an electronic device manufacturing system including multiple component lift assemblies according to embodiments.

Another electronic device processing system 100 is shown in FIG. 10. The electronic device processing system 100 includes a plurality of substrate processing tools 101A, 101B, 101C positioned on a floor 134, each of the substrate processing tools including FAB components that may be moved to install or removed for service. One or more component lift assemblies 104, 105 may be provided, and are adapted and operational to lift or lower one or more of the FAB components. Component lift assemblies 104, 105 may include or more tracks 108 with a truck 110 moveable along each of the one or more tracks 108. Each of the lift apparatus 106 (e.g., lift apparatus 106 shown in FIGS. 2 and 7) of the component lift assemblies 104, 105 is adapted to couple to a truck 110. Lift apparatus 106 may include, as previously discussed, a wheeled base 112, a lift portion 114 coupled to the wheeled base 112, and a boom 116 coupled to a moveable portion 114M of the lift portion 114 and adapted to couple to the one or more FAB components. Each of the plurality of lift apparatus 106 used in the component lift assemblies 104, 105 may be identical. As shown, the one or more tracks 108 are mounted under the floor 134. Once the lift apparatus 106 are removed, the floor tiles over the tracks 108 may be replaced. The lift apparatus 106 may be stored in the folded configuration shown in FIG. 5A.

Figure 5B:
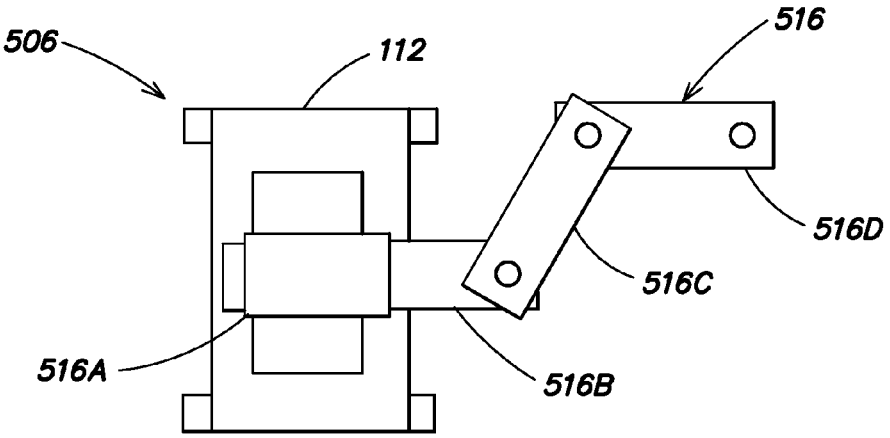
FIG. 5B illustrates a top plan view of a lift apparatus including an articulating boom configuration according to embodiments.

FIG. 5B illustrates another embodiment of a lift apparatus 506. In this embodiment, the boom 516 includes multi-piece construction including a plurality of boom portions (boom portions 516A-516D). In the depicted embodiment, the boom portions 516B-516D may articulate, that is, rotate relative to one another, in a horizontal plane, as shown. The boom 516 may include, in one or more embodiments, two portions that reciprocate relative to one another, such as first boom portion 516A and second boom portion 516B. This allows the connection point on the boom 516 to be moved laterally away from the track 108. If the boom 516 includes articulation capability, the number of articulating boom portions may include only one (like third boom portion 516C), two (like third boom portion 516C and fourth boom portion 516D), or even more than two. Additional articulating boom portions may be added or removed, as desired, by removal of a pivot pin at the articulating joint.

Figure 5D:
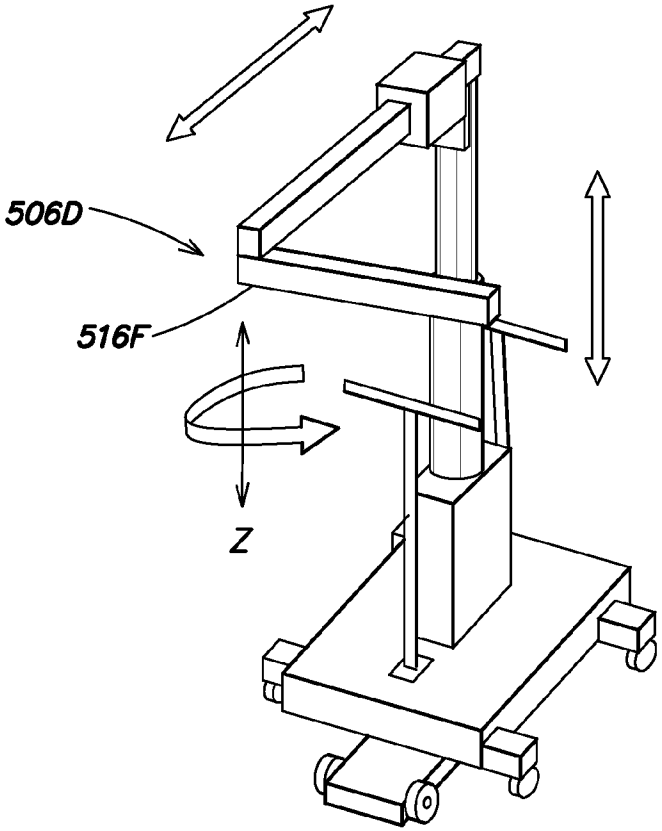
FIGS. 5C and 5D illustrate perspective views of alternative articulating lift apparatus according to embodiments.
Figure 5C:
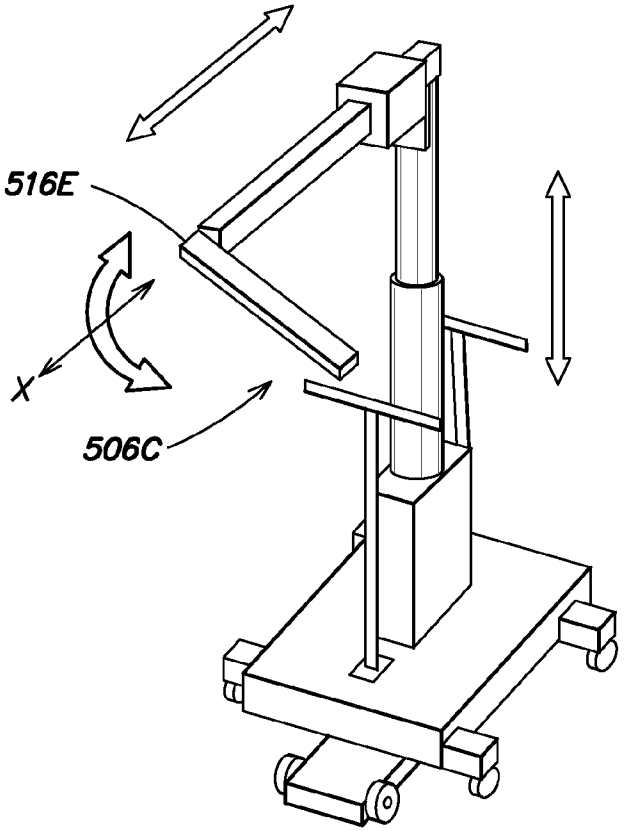
Figure 6:
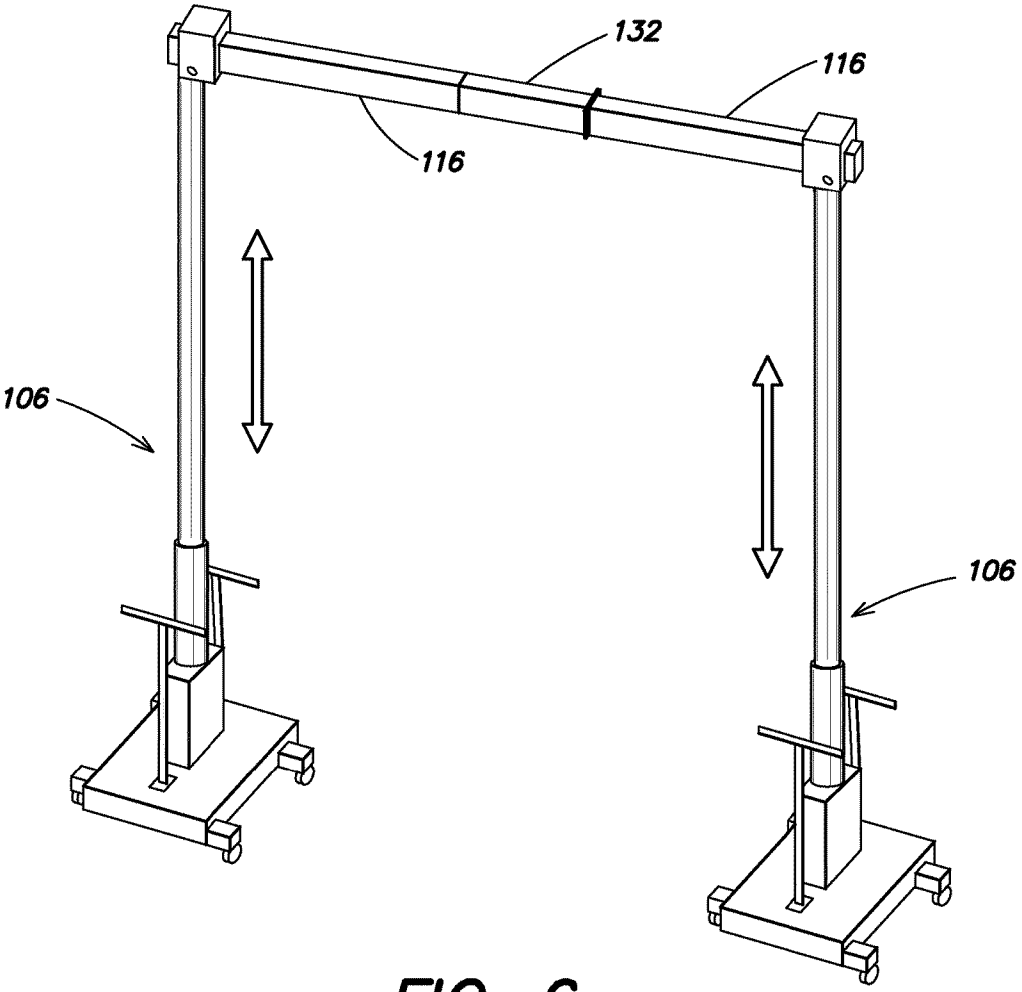
FIG. 6 illustrates a perspective view of a dual lift apparatus according to embodiments.

Furthermore, as shown in FIGS. 5C and 5D, lift apparatus 506C, 506D having other types of hinged joints and articulation capability may be provided. For example, FIG. 5C illustrates a lift apparatus 506C having a boom portion 516E that articulates about an X axis. Lift apparatus 506D shown in FIG. 5D may include a boom having a hinge joint that allows a boom portion 516F to articulate around a Z axis (e.g., a vertical axis). However, other embodiments may articulate about a Y axis or any desired horizontal axis. Some embodiments may even include a spherical joint between boom portions. Any suitable attachment may be used to connect the component to be moved to a boom portion, such as a hook, cable, chain, plate, or the like.

Figure 13:
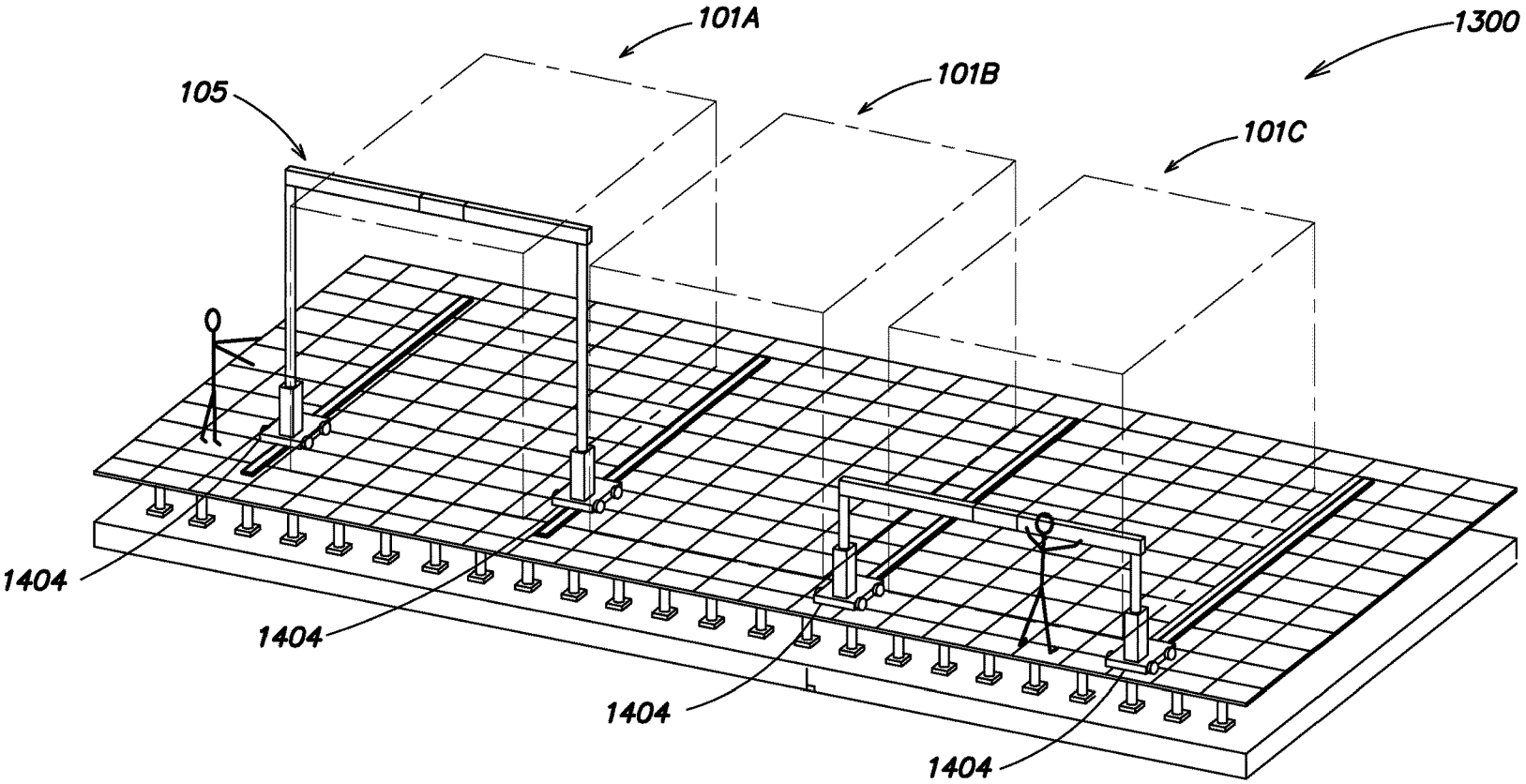
FIG. 13 illustrates another perspective view of an electronic device manufacturing system including multiple component lift assemblies according to embodiments that are shown being positioned at two different lift heights.
Figure 14:
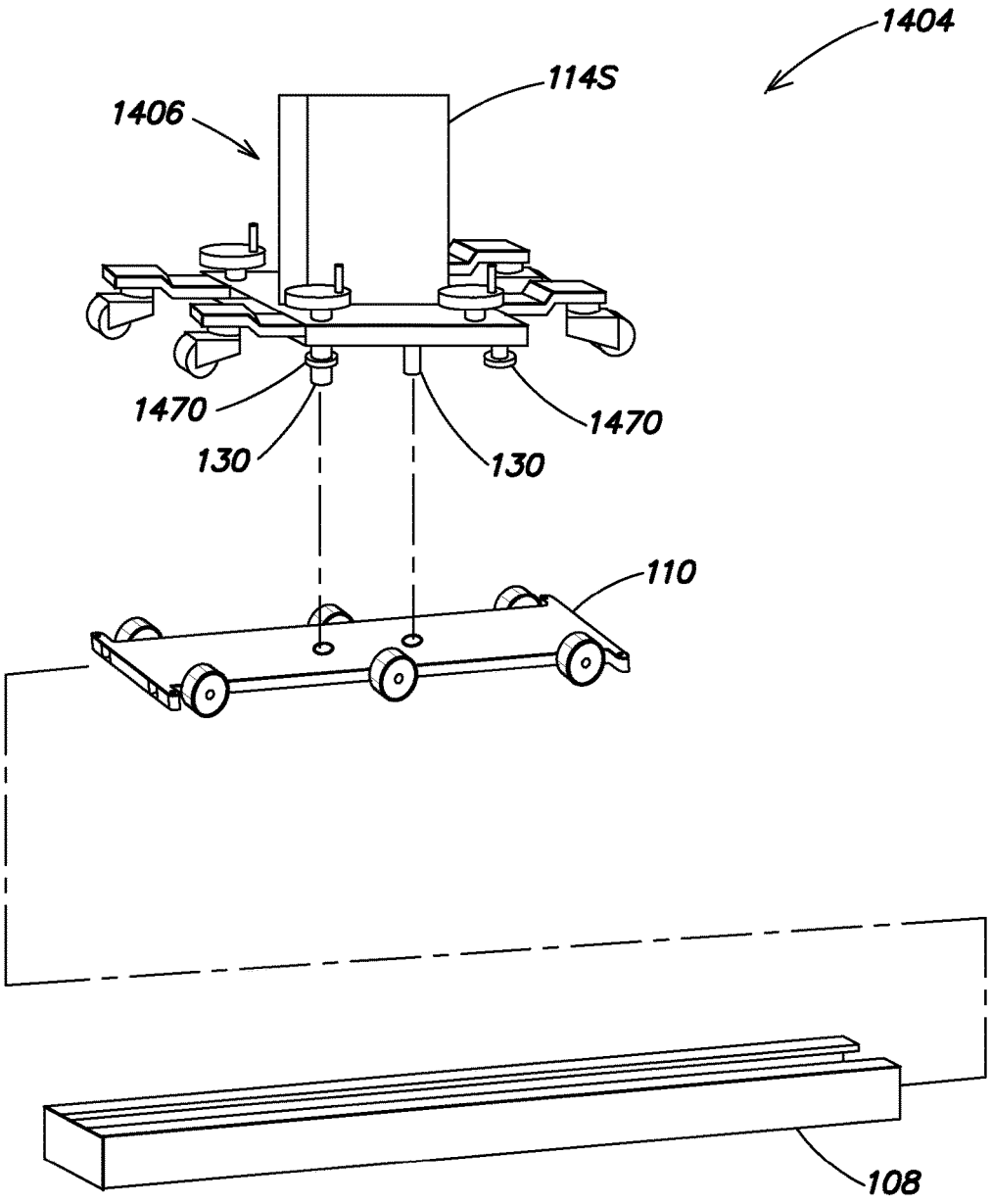
FIG. 14 illustrates a partial exploded view of a component lift assembly including stabilizers according to embodiments.
Figure 15:
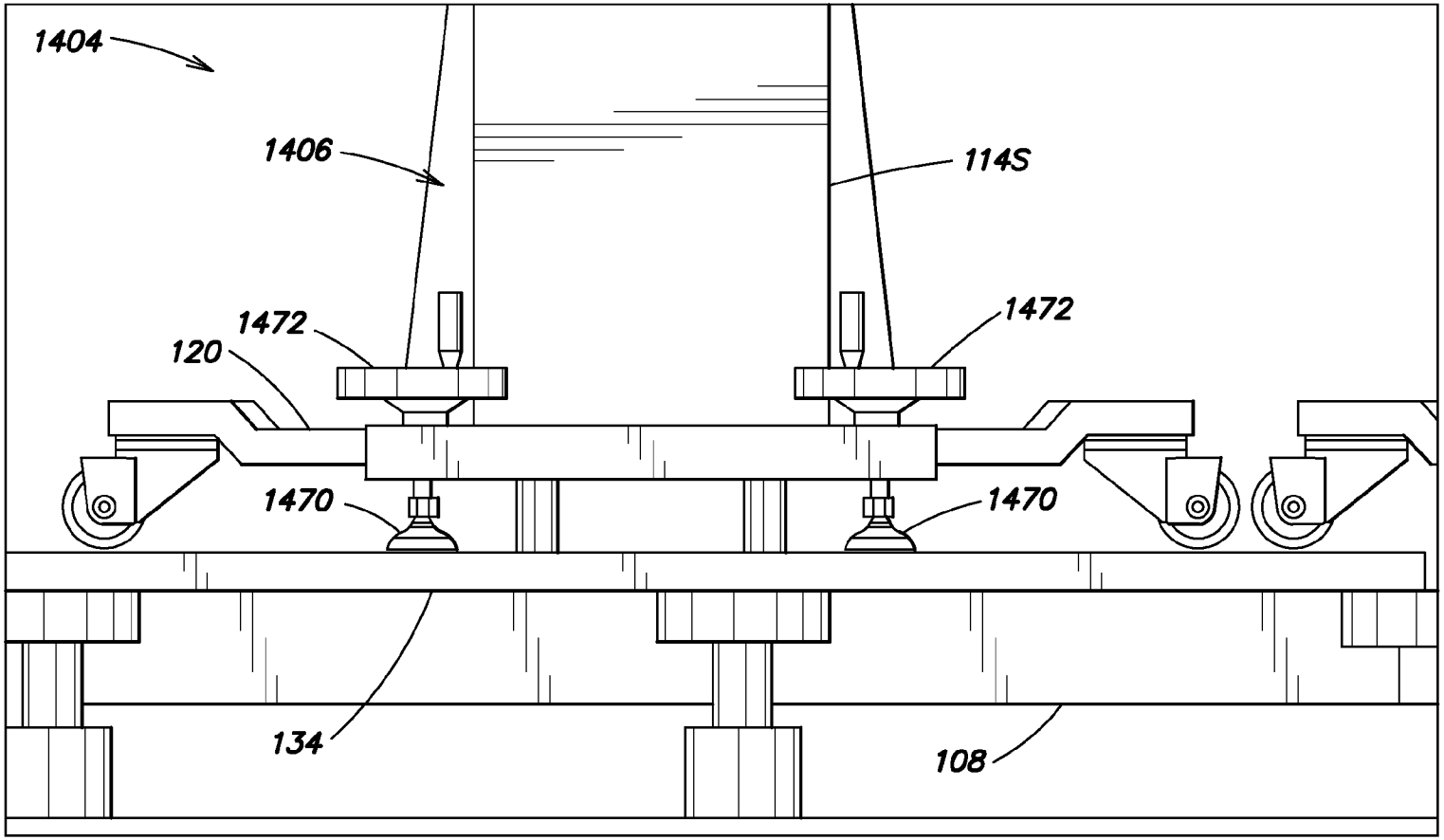
FIG. 15 illustrates a side view of a portion of the component lift assembly within the floor structure according to embodiments.

FIG. 13-15 illustrates a manufacturing system 1300 including substrate processing tools 101A-101C and multiple lift assemblies 1404. Lift assemblies 1404 are similar to those previously described, including a lift apparatus 1406, truck 110, and track 108. This embodiment of lift apparatus 1406 includes multiple stabilizers 1470. Stabilizers 1470 may be lowered to engage the floor 134 by cranks 1472 or other suitable mechanisms.

Figure 16:
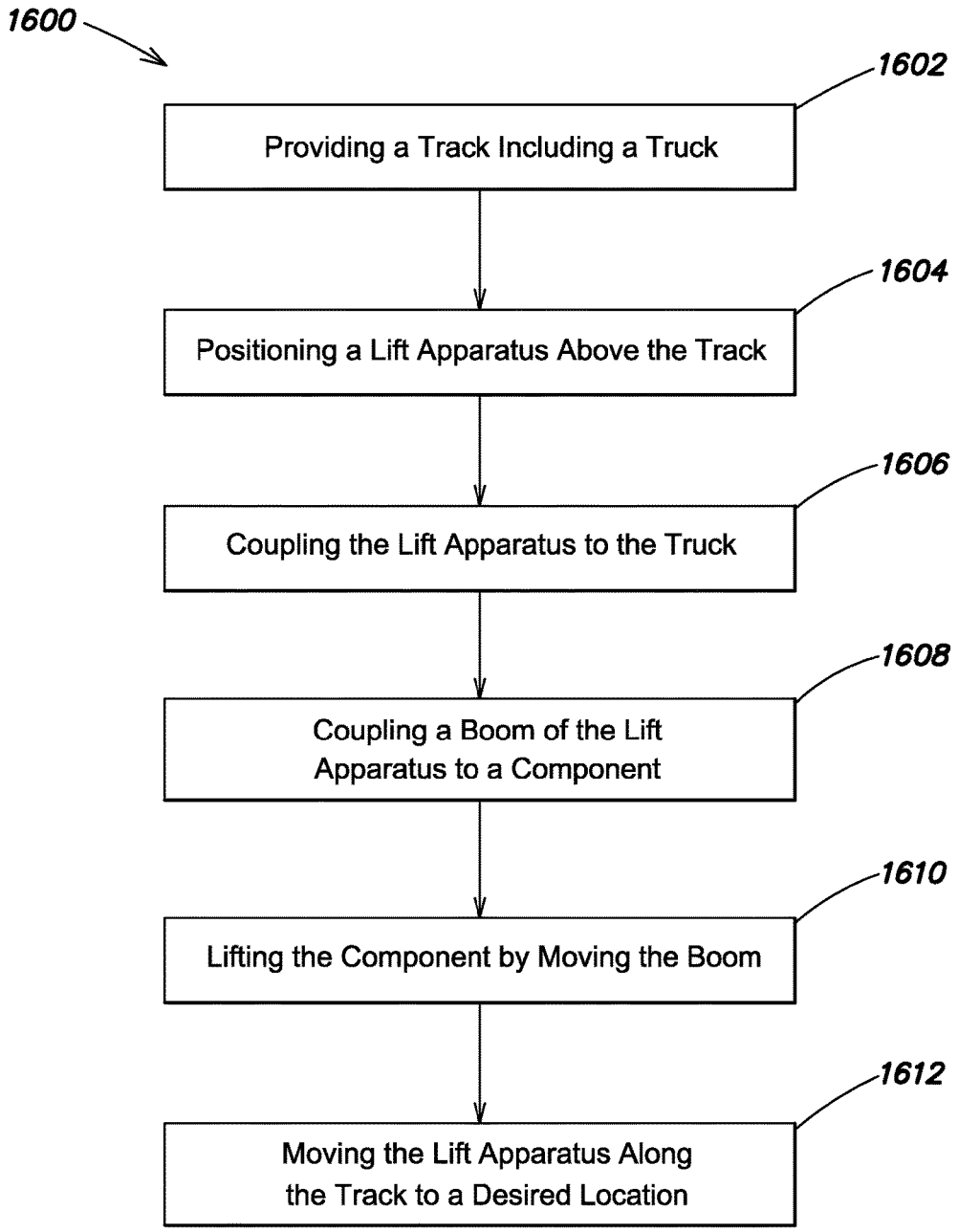
FIG. 16 illustrates a flowchart of a method of moving a component of according to embodiments.

A method 1600 of moving a component of an electronic device processing system according to embodiments of the present invention is illustrated in the flowchart of FIG. 16. The method 1600 includes, in 1602, providing a track (e.g., track 108) including a truck (e.g., truck 110); positioning a lift apparatus (e.g., lift apparatus 106, 506C, 506, 1406) above the track in 1604; coupling the lift apparatus to the truck in 1606; coupling a boom (e.g., boom 116, 516E, 516F) of the lift apparatus to the component (e.g., component of a substrate processing tool 101A-101C) in 1608; lifting the component by moving the boom in 1610; and moving the lift apparatus along the track to a desired location in 1612.

Figure 17:
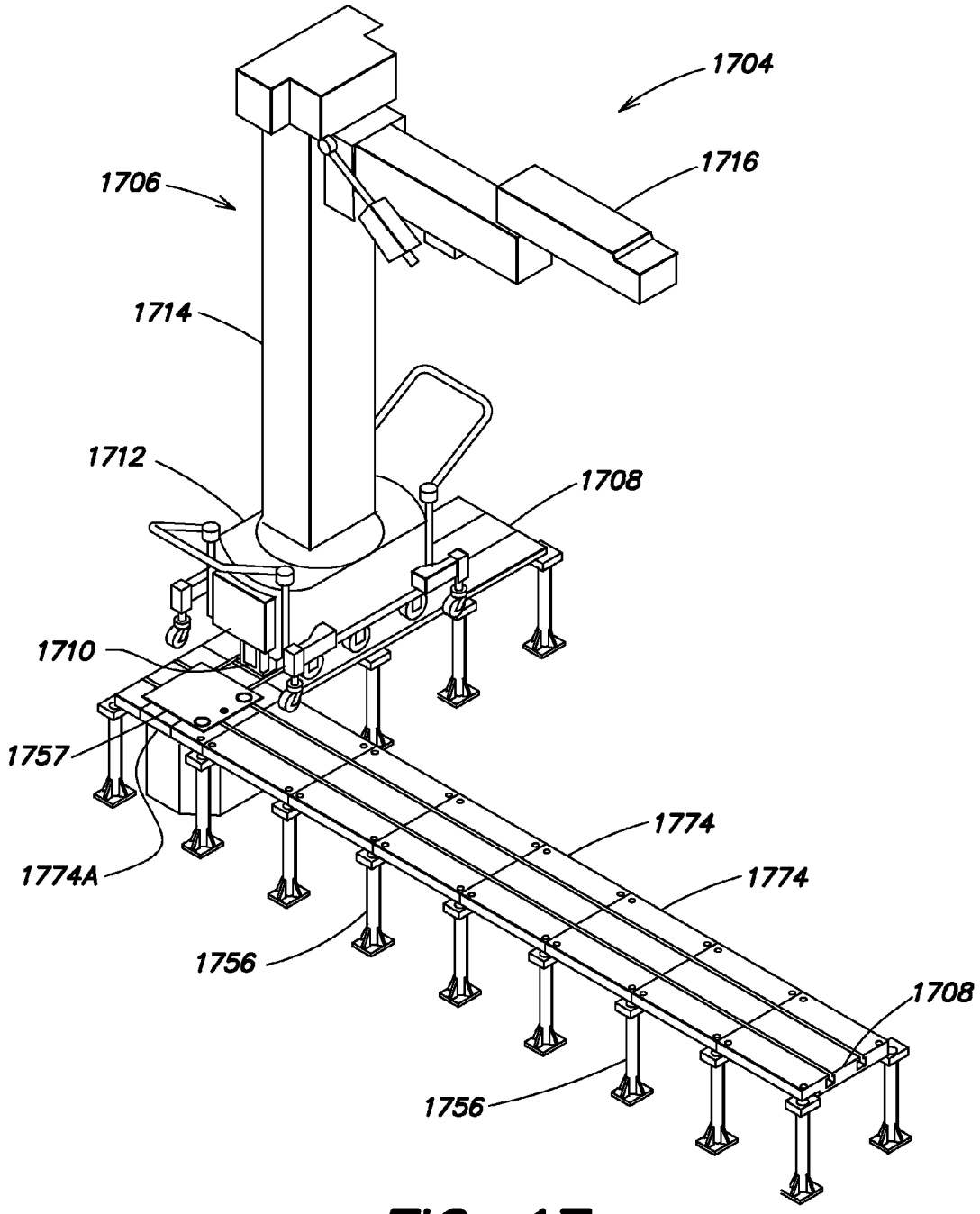
FIG. 17 illustrates a perspective view of an alternate embodiment of a component lift assembly according to embodiments.

FIGS. 17-21B illustrate another embodiment of the component lift assembly 1704 and the various parts thereof. As best shown in FIGS. 17 and 18A, component lift assembly 1704 includes a track 1708, a truck 1710 moveable along the track 1708, and a lift apparatus 1706 adapted to couple to the truck 1710. The lift apparatus 1706, as has been previously described, may include a wheeled base 1712, a lift portion 1714, and a boom 1716 adapted to couple to a component of a tool (not shown) so that the component may be moved (e.g., installed or removed). Boom 1716 may include multiple boom portions and may include articulation capability. Like before, lift portion 1714 is coupled to the wheeled base 1712, and the lift portion 1714 includes a stationary portion 1714S coupled to the wheeled base 1712, and a moveable portion 1714M moveable relative to the stationary portion 1714S, and the boom 1716 coupled to the moveable portion 1714M. Moveable portion 1714M may move up and down on a rack formed on stationary portion 1714S, for example. Suitable motors may be used to accomplish the lifting which may be built into the lift apparatus 1706.

In this embodiment, the track 1708 may be made up of a plurality of tiles 1774 (a few labeled). Track 1708 may include multiple track sections, some of which may intersect each other. Two intersecting track sections are shown in FIG. 17. However, it should be understood that any number of track sections may be used, such as between tools, alongside of tools, at the end of one or more tools, and other orientations or combinations of the foregoing. Each track section may each be made up of a plurality of tiles 1774. Each tile 1774 may be supported by track supports 1756 (a few labeled). Track supports 1756 may be coupled to a floor such as floor base 950, or other intermediate structure, such as a first support structure 952. As shown, each tile 1774 is directly supported by four track supports 1756, such as at the corners thereof. The tiles 1774 may be arranged in a row to form the track 1708 and each tile 1774 may be coupled to the four track supports 1756 by fasteners, such as bolts or the like. Portions of existing elevated floor structure (not shown) may be cut out to allow the installation of the tiles 1774 and track supports 1756. Tiles 1774 may be installed flush with the existing elevated floor, for example.

Figure 21A:
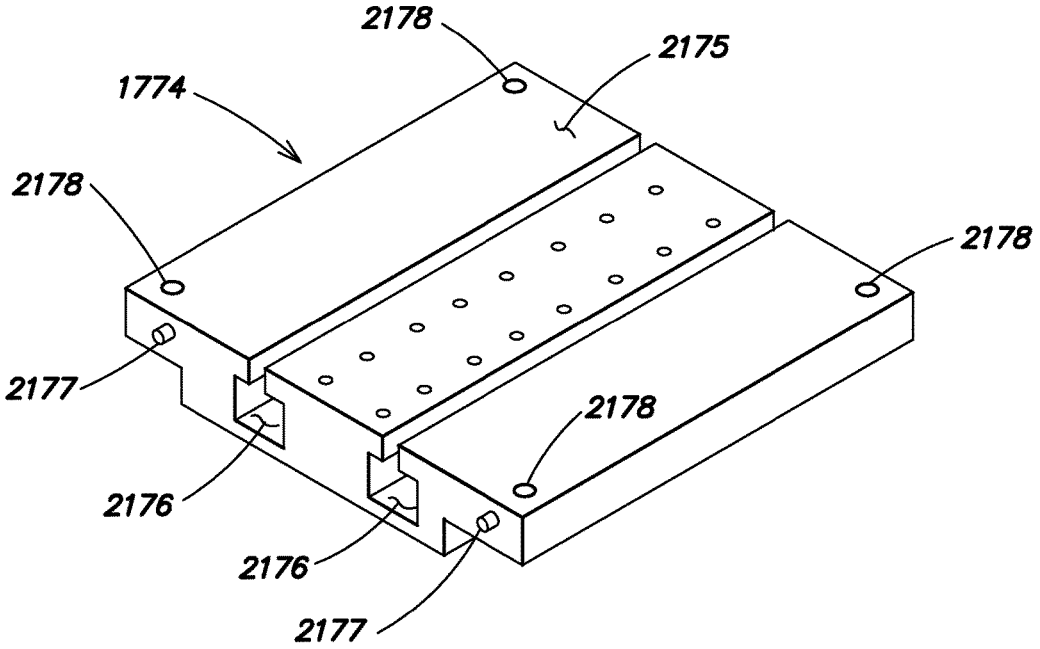
FIGS. 21A-21B illustrates a perspective view and end view, respectively, of a tile of a track according to embodiments.
Figure 21B:
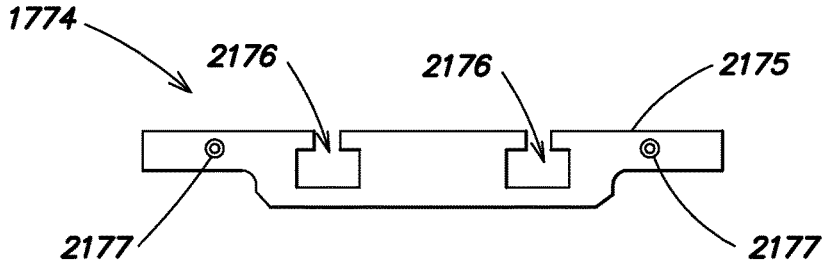

FIGS. 21A-21B illustrates one embodiment of the tile 1774. Tile 1774 includes an upper surface 2175 upon which the wheels 1880 of the lift apparatus 1706 will ride (See FIG. 18C. Tile 1774 includes slots 2176, which may be spaced apart T-slots. The slots 2176 may extend from end to end of the tile 1774. Truck wheels 1924 of the truck 1710 may ride in the slots 2176. Side wheels 1926 (see FIG. 19A) of the truck 1710 may ride in the slots 2176. As such, the truck 1710 may be retained within the track 1708 and may be limited in side-to-side motion, vertical motion, and tipping/rocking motion. However, the truck 1710 may move back and forth axially within the slots 2176. The tiles 1774 may include one or more pins 2177 on one end that are received in holes in an end of the next adjacent tile 1774. In this manner, slots 2176 may be aligned from the tile 1774 to the next adjacent tile. Other suitable alignment means may be used. Countersunk holes 2178 may be provided to receive fasteners (not shown) to fasten the tiles 1774 to the track supports 1756.

Figure 20:
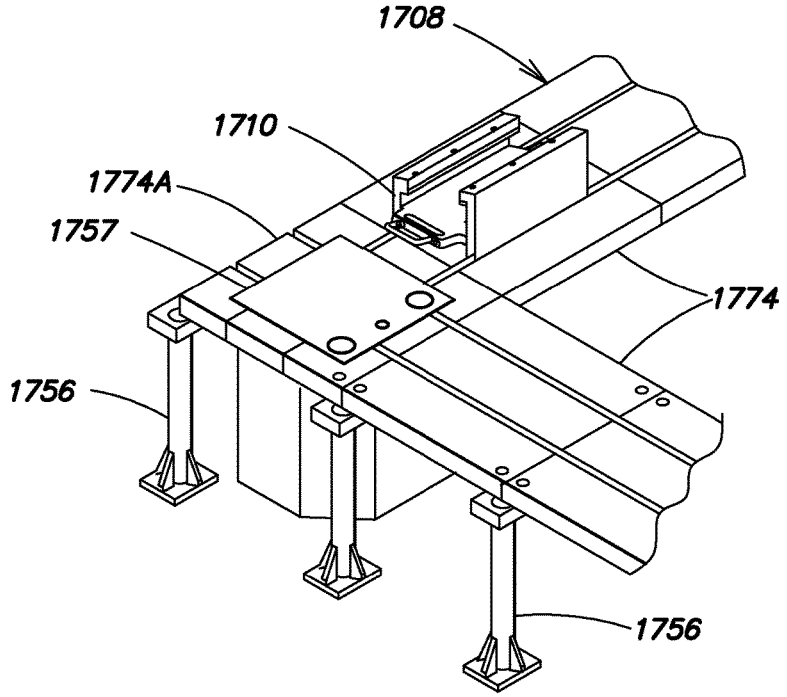
FIG. 20 illustrates a perspective view of an alternate configuration of a track including modular tile construction and an access tile according to embodiments.

As shown in FIGS. 17 and 20, one tile, such as access tile 1774A may include an access door 1757. Because the track 1708 is surrounded by the elevated floor, the access door 1757 may be raised and allow one or more trucks 1710 to be installed onto the track 1708 by inserting the truck wheels 1924 into the slots 2176.

Figure 19A:
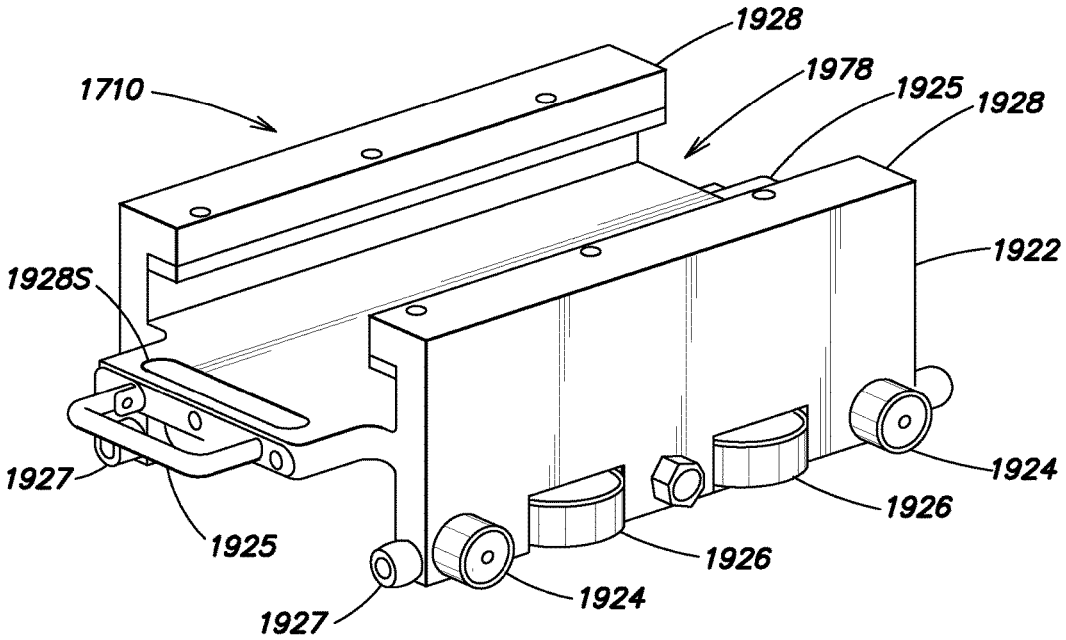
FIGS. 19A-19B illustrates a perspective view and a top view, respectively, of an alternate embodiment of a truck of a component lift assembly according to embodiments.
Figure 19B:
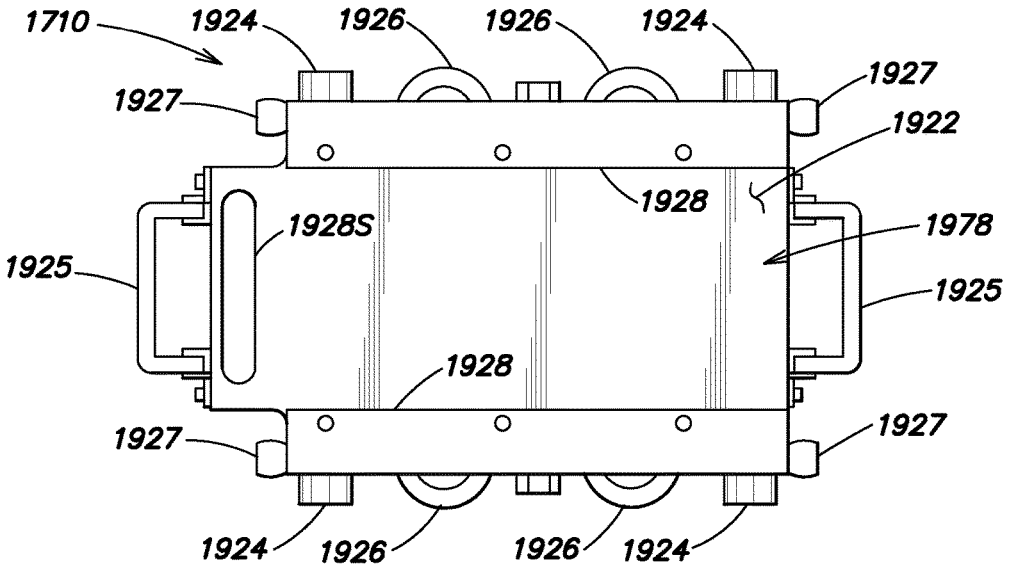
Figure 19C:
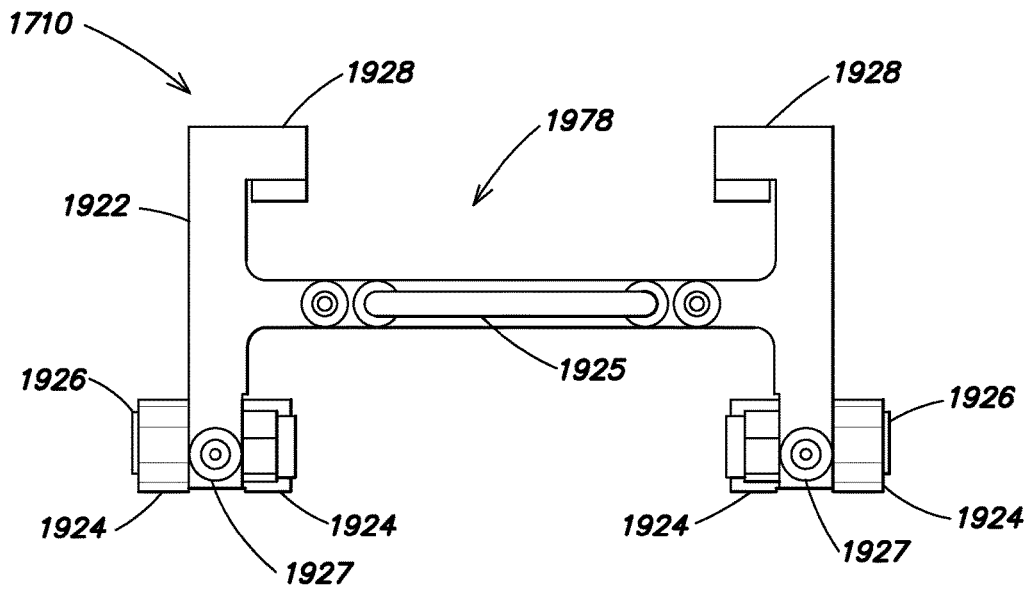
FIG. 19C illustrates an end view of an alternate embodiment of a truck according to embodiments.

In this embodiment, the truck 1710, as shown in FIG. 19A-19C, may include a truck frame 1922 with the truck wheels 1924 and the side wheels 1926 coupled thereto and rotatable thereon. Truck wheels 1924 may engage and run on a horizontal portion of the slots 2176. Side wheels 1926 engage and run on the vertical portion of the slots 2176. Truck wheels 1924 and the side wheels 1926 may be made of any suitably hard material, such as metal, hard rubber, thermoplastic elastomer, urethane, combinations of the foregoing, or the like. Other wheel types may be used.

The top side of the truck 1710 may include one or more lift engagement features 1928 adapted to engage with one or more truck engagement features 1830 on the lift apparatus 1706. In this embodiment, the lift engagement features 1928 may be two shelves, which form a retaining channel 1978 that may be configured to receive a complementary-shaped truck engagement feature 1830 as shown in FIG. 18C. Lift engagement features 1928 cooperate with truck engagement features 1830 to constrain the lift apparatus 1706 to linear motion along the track 1708, by also tie the lift apparatus 1706 to the track so that the lift apparatus 1706 cannot move laterally or appreciably tilt/rock relative to the track 1708, thus stabilizing and securing the lift apparatus 1706 to the track 1708.

Truck 1710 may include one or more handles 1925 configured to assist with the installation of the truck 1710 onto the track 1708. Truck 1710 may include bumper stops 1927 on one or more ends to limit motion of the truck 1710 underneath the lift apparatus 1706. One or more secondary lift engagement features 1928S, such as the groove shown, may be included on the truck 1710 and configured to connect and lock the truck 1710 to the lift apparatus 1706 in the direction of the track 1708, such that the truck 1710 and the lift apparatus 1706 may only move together along the track 1708. Any suitable secondary truck engagement feature 1830S may be used, such as a spring-loaded latch bolt or the like.

Figure 18A:
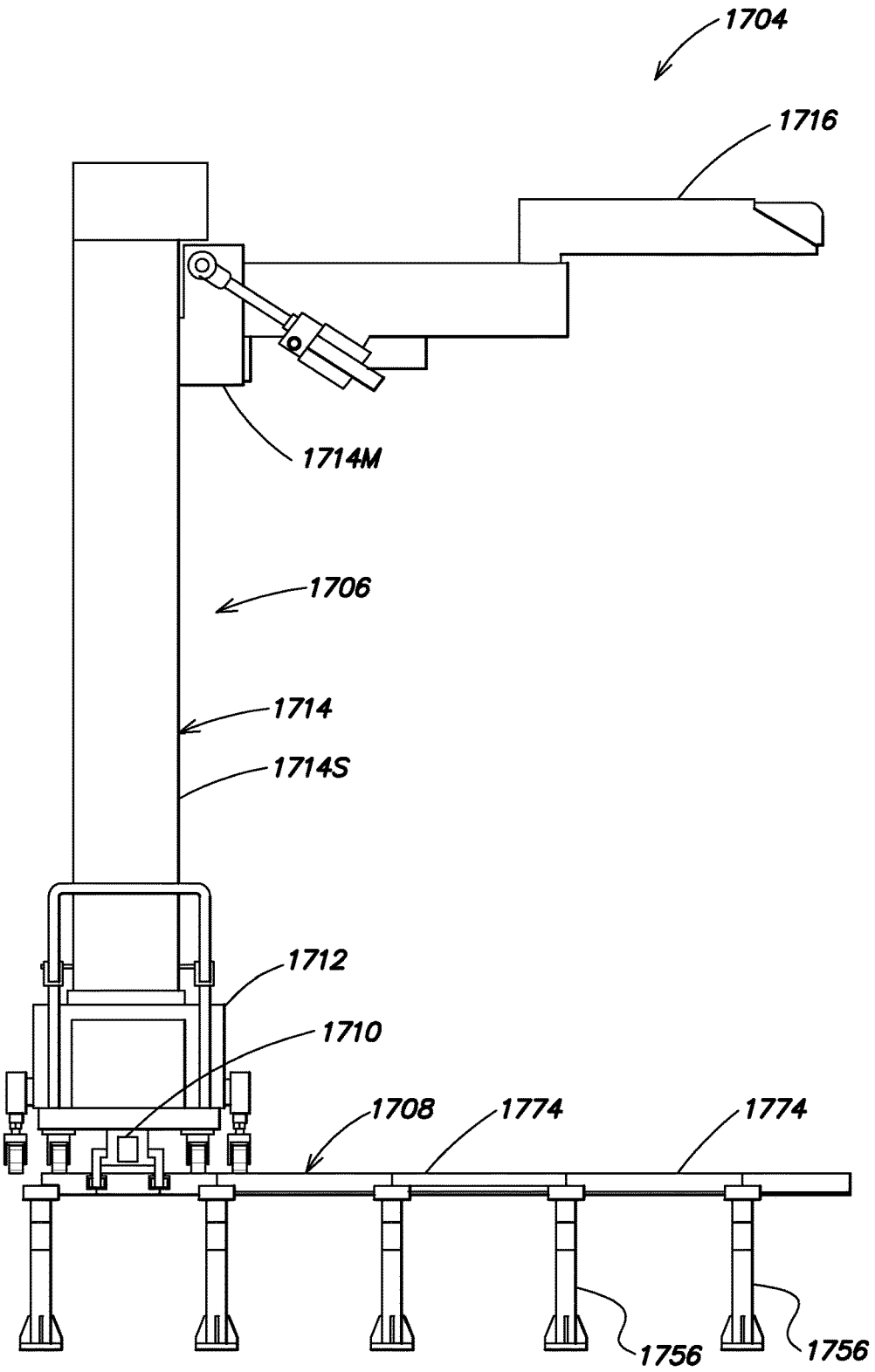
FIG. 18A illustrates a side view of an alternate embodiment of a component lift assembly according to embodiments.
Figure 18B:
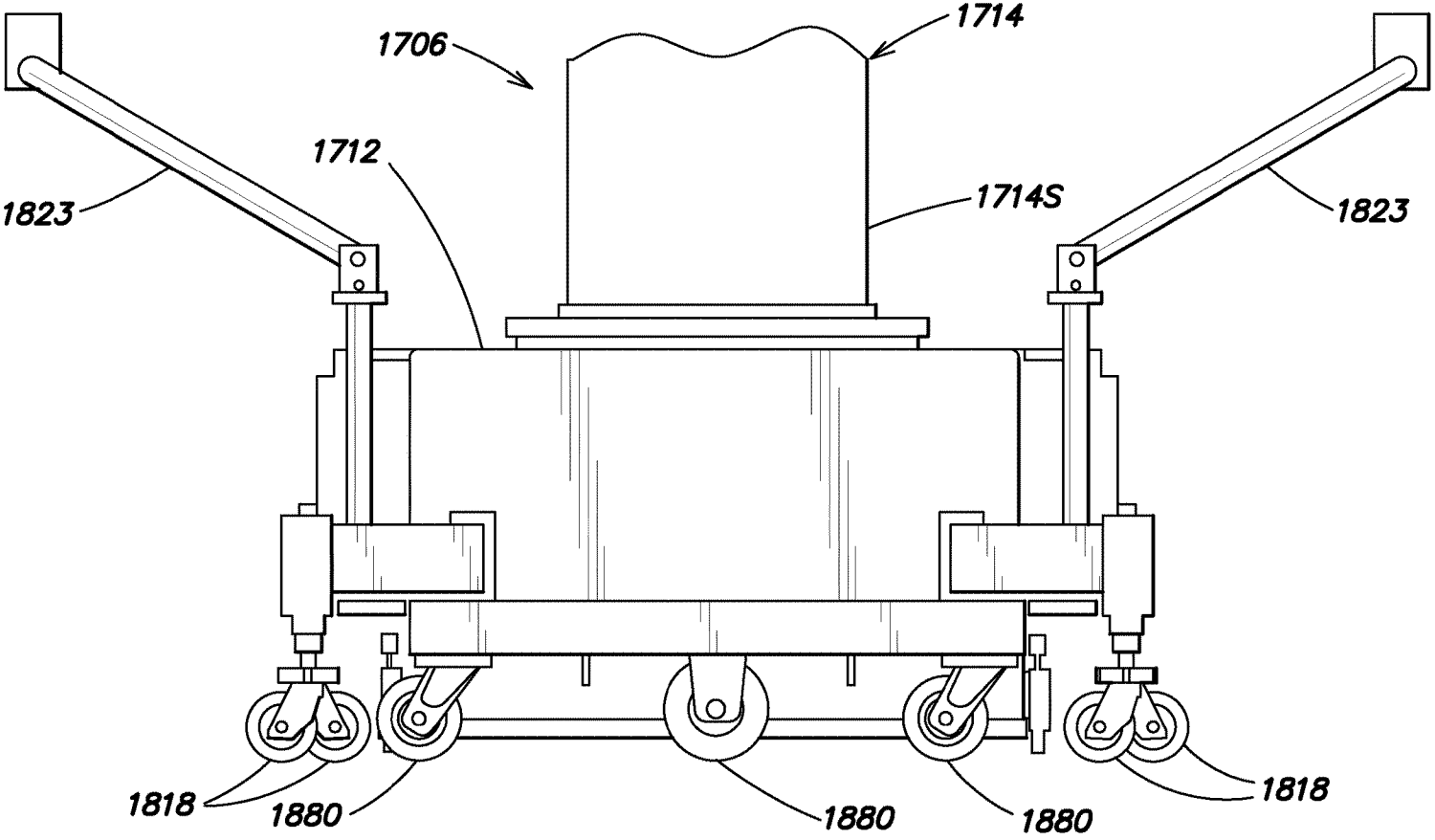
FIG. 18B illustrates a partial side view of an alternate embodiment of a lift apparatus according to embodiments.
Figure 18C:
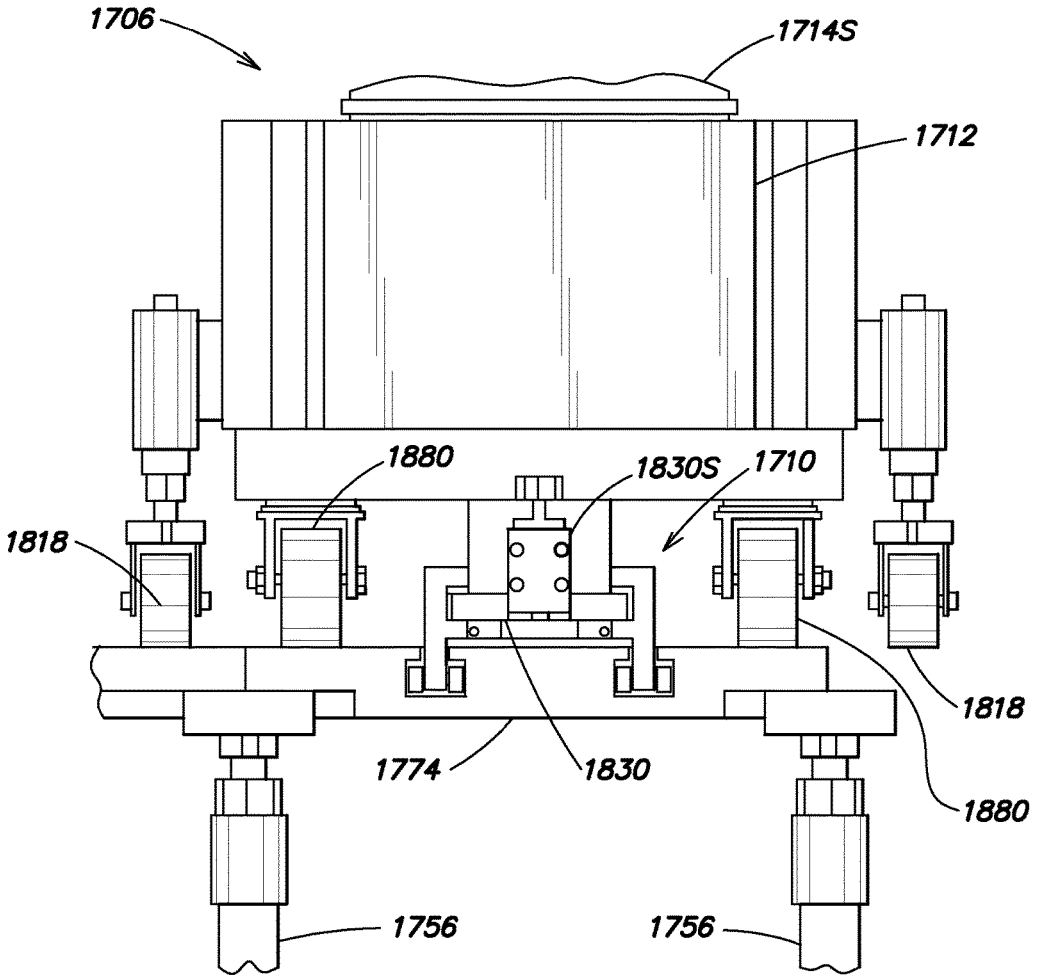
FIG. 18C illustrates a partial end view of an alternate embodiment of a lift apparatus according to embodiments.

Referring now to FIGS. 18B and 18C, the lift apparatus 1706 (only a portion shown) may include a wheeled base 1712 with one or more tow handles 1823 coupled thereto. In this embodiment, wheeled base 1712 includes both load wheels 1880 and retractable wheels 1818. Load wheels 1880 together with truck wheels 1924 carry vertical loads and moments due to lifting of components by the lift apparatus 1706. Retractable wheels 1818 may be used when the lift apparatus 1706 is being moved off the track 1708 to provide extra stability.

The foregoing description discloses only example embodiments of the invention. Modifications of the above-disclosed apparatus, systems and methods which fall within the scope of the invention will be readily apparent to those of ordinary skill in the art. Accordingly, while the present invention has been disclosed in connection with example embodiments, it should be understood that other embodiments may fall within the scope of the invention, as defined by the following claims.

The invention claimed is:

1. A component lift assembly, comprising:

one or more tracks;

one or more trucks moveable along the one or more tracks; and one or more lift apparatus adapted to detachably couple to the one or more trucks via a vertical downward insertion of a truck engagement feature of the one or more lift apparatus into a lift engagement feature of the one or more trucks, the one or more lift apparatus including a wheeled base, a lift portion, and a boom adapted to couple to a component;

wherein the lift portion includes a stationary portion and a vertically moveable portion that is telescopeable relative to the stationary portion, the boom is coupled to the vertically moveable portion at an uppermost portion thereof, such that a portion of the boom intersects a vertical axis of the vertically moveable portion, and the wheeled base further includes two or more stabilizers configured to extend downwardly from an underside of the wheeled base, and further configured to engage a floor.

2. The component lift assembly of claim 1, wherein the one or more tracks comprises a monorail including a captured channel which is adapted to capture one or more trucks therein.

3. The component lift assembly of claim 1, wherein the one or more tracks comprise a monorail mounted in an under-floor configuration.

4. The component lift assembly of claim 1, wherein the floor comprise a plurality of tiles.

5. The component lift assembly of claim 1, wherein each one of the one or more trucks comprise a truck frame and four or more truck wheels rotationally coupled to the truck frame and adapted to engage the one or more tracks.

6. The component lift assembly of claim 1, wherein each one of the one or more trucks comprise one or more side wheels.

7. The component lift assembly of claim 1, wherein each one of the one or more trucks comprise a truck frame and truck wheels and side wheels rotationally coupled to the truck frame, and the truck wheels and side wheels are configured to run in slots.

8. The component lift assembly of claim 1, wherein each one of the one or more trucks comprise two or more lift engagement features adapted to detachably engage with two or more truck engagement features of the lift apparatus.

9. The component lift assembly of claim 1, wherein the wheeled base comprises two or more truck engagement features adapted to detachably engage two or more lift engagement features on a truck of the one or more trucks.

10. The component lift assembly of claim 1, wherein the boom includes a plurality of boom portions.

11. The component lift assembly of claim 10, wherein at least some of the plurality of boom portions include articulation capability.

12. The component lift assembly of claim 1, comprising a first lift apparatus coupled to a first truck, and a second lift apparatus coupled to a second truck, and wherein respective booms of the first lift apparatus and the second lift apparatus are coupled with a bridge bracket.

13. An electronic device processing system, comprising:

a plurality of substrate processing tools positioned on a floor, each of the substrate processing tools including one or more components;

one or more lift assemblies adapted to lift or lower one or more of the components, comprising:

one or more tracks;

a truck moveable along each of the one or more tracks; and a lift apparatus adapted to detachably couple to the truck via a vertical downward insertion of a truck engagement feature of the lift apparatus into a lift engagement feature of the truck, the lift apparatus including a wheeled base, a vertical lift coupled to the wheeled base, and a boom coupled to a vertically moveable portion of the vertical lift and adapted to couple to the one or more components;

wherein the vertical lift includes a stationary portion, and the vertically moveable portion of the vertical lift is telescopeable relative to the stationary portion, the boom is coupled to the vertically moveable portion of the vertical lift at an uppermost portion thereof, such that a portion of the boom intersects a vertical axis of the vertically moveable portion, and the wheeled base further includes two or more stabilizers configured to extend downwardly from an underside of the wheeled base, and further configured to engage the floor.

14. The electronic device processing system of claim 13, wherein the one or more tracks comprises a plurality of tracks and a plurality of identical lift apparatus each coupled to a respective truck moving along each track.

15. The electronic device processing system of claim 13, wherein the truck comprises two or more lift engagement features adapted to detachably engage with two or more truck engagement features on the lift apparatus.

16. The electronic device processing system of claim 13, wherein the one or more tracks are mounted under the floor.

17. The electronic device processing system of claim 13, wherein the truck engagement feature comprises one or more pins extending from the wheeled base configured to be received respectively in the lift engagement feature comprising one or more holes formed in a frame of the truck.

18. A method of moving a component of an electronic device processing system, comprising:

providing a track including a truck;

positioning a lift apparatus, including a wheeled base, above the track;

coupling the lift apparatus to the truck via two or more truck engagement features on the lift apparatus adapted to detachably engage with two or more lift engagement features on the truck by vertically inserting downward the two or more truck engagement features into the two or more lift engagement features;

extending a plurality of stabilizers downwardly from an underside of the wheeled base and into engagement with a floor;

coupling a boom of the lift apparatus to the component;

lifting the component by moving the boom; and moving the lift apparatus along the track to a desired location;

wherein the lift apparatus includes a stationary portion and a vertically moveable portion that is telescopeable relative to the stationary portion, and the boom is coupled to the vertically moveable portion at an uppermost portion thereof, such that a portion of the boom intersects a vertical axis of the vertically moveable portion.

* * * * *